US005302310A

United States Patent [19]

Houghton

[11] Patent Number: 5,302,310

[45] Date of Patent: Apr. 12, 1994

[54] DETERGENT COMPOSITIONS CONTAINING A CARBONATE BUILDER, A SEED CRYSTAL AND AN IMMOBILIZED SEQUESTRANT

[75] Inventor: Mark P. Houghton, Rotterdam, Netherlands

[73] Assignee: Lever Brothers Company, Division of Conopco, Inc., New York, N.Y.

[21] Appl. No.: 55,442

[22] Filed: Apr. 29, 1993

[30] Foreign Application Priority Data

Apr. 30, 1992 [GB] United Kingdom ..... 9209366

[51] Int. Cl.[5] ..... C11D 3/10; C11D 3/12; C11D 3/30; C11D 3/36

[52] U.S. Cl. ..... 252/95; 252/99; 252/102; 252/140; 252/174.13; 252/174.14; 252/174.16; 252/174.23; 252/174.24; 252/174.25; 252/179; 252/180; 252/181; 252/526; 252/527; 252/545; 252/546; 252/DIG. 11

[58] Field of Search ..... 252/95, 102, 140, 174.13, 252/174.14, 174.16, 174.23, 174.24, 174.25, 179, 180, 181, 526, 527, 545, 546, DIG. 11

[56] References Cited

U.S. PATENT DOCUMENTS

| | | | |
|---|---|---|---|
| 3,850,852 | 11/1974 | Neillie et al. | 252/536 |
| 4,071,546 | 1/1978 | Plueddemann | 252/175 |
| 4,076,653 | 2/1978 | Davies | 252/532 |
| 4,088,593 | 5/1978 | Roebke | 252/179 |
| 4,138,363 | 2/1979 | Hertzenberg | 252/179 |
| 4,216,125 | 8/1980 | Campbell | 252/527 |
| 4,454,056 | 6/1984 | Kittelmann | 252/174.15 |
| 4,530,963 | 7/1985 | De Voe | 252/8.551 |

*Primary Examiner*—Dennis Albrecht
*Attorney, Agent, or Firm*—Ronald A. Koatz

[57] ABSTRACT

A cleaning composition comprises an alkali metal carbonate detergency builder with a seed crystal material therefor and a heavy metal seqestrant. To avoid deleterious interactions with the seed crystal material, the sequestrant is imobilised on a high surface area solid support medium. The composition may be in the form of powders, aqueous liquids, substantially non-aqueous liquids, gels or pastes.

9 Claims, No Drawings

DETERGENT COMPOSITIONS CONTAINING A CARBONATE BUILDER, A SEED CRYSTAL AND AN IMMOBILIZED SEQUESTRANT

The present invention relates to cleaning compositions, in particular to detergent compositions such as substantially non-aqueous liquid detergent compositions. Non-aqueous liquid detergent compositions are those containing little or no water. However, the invention extends also to powder and aqueous liquid compositions with or without detergent and to non-aqueous liquid cleaning products without detergent.

Of the liquid compositions, those which are substantially non-aqueous are generally preferred when it is desired to incorporate bleach, because the water in aqueous compositions causes instability of the bleach.

In cleaning compositions fabrics washing, the oxygen bleaches are preferred, for example in the form of an inorganic persalt, preferably with a bleach precursor.

In the case of the inorganic persalt bleaches, the precursor makes the bleaching more effective at lower temperatures, i.e. in the range from ambient temperature to about 60° C., so that such bleach systems are commonly known as low-temperature bleach systems and are well-known in the art. The inorganic persalt such as sodium perborate, either the monohydrate or the tetrahydrate, acts to release active oxygen in solution, and the precursor is usually an organic compound having one or more reactive acyl residues, which cause the formation of peracids, the latter providing for a more effective bleaching action at lower temperatures than the peroxybleach compound alone.

In the wash, the active bleach, i.e. hydrogen peroxide or peracid e.g. formed from a persalt and precursor, is readily decomposed by any heavy metal ions present, before it can exert its desired bleaching effect on the fabrics. This occurs particularly with the transition metals of the first row of the periodic table, e.g. copper, iron and titanium which are found at trace levels in tap-water, e.g. 1–10 parts per million, depending on the source.

To counteract this, it is conventional to include a heavy metal sequestrant, usually a phosphonic acid derivative. Typical sequestrants are those sold by Degussa under the trade name 'Dequest'.

Whether or not a bleach system is included in the formulation, it is also known to incorporate sequestrants in compositions intended for fabrics washing, in order to assist in the removal of certain stains such as grass.

It is also common to incorporate detergency builders in cleaning compositions. The detergency builders are those materials which counteract the effects of calcium, or other ion, water hardness, either by precipitation or by an ion sequestering effect. They comprise both inorganic and organic builders. They may also be subdivided into the phosphorus-containing and non-phosphorus types, the latter being preferred when environmental considerations are important.

A particularly important class non-phosphorus builders are the alkali metal carbonates, e.g. sodium carbonate. These carbonates counteract calcium water hardness reacting with the calcium ions to form insoluble calcium carbonate. Unfortunately, calcium carbonate deposits tend to adhere to fabrics in the wash liquor, causing the well-known "ashing" phenomenon. It is common to avoid this by including a seed crystal substance such as calcite for the precipitated calcium carbonate to grow on. Calcite is a particular crystaline form of calcium carbonate. The seed crystals with grown layer of calcium carbonate readily remain dispersed in the wash liquor.

Unfortunately, the seed crystals are poisoned if heavy metal sequestrants are present, leading to a measurable decrease in builder effectiveness.

We have now found a way of avoiding this poisoning, by immobilising the sequestrant on a high surface area solid support medium.

Thus, the present invention provides a cleaning composition comprising an alkali metal carbonate builder with a seed crystal material therefor and a heavy metal sequestrant, wherein the heavy metal sequestrant is immobilised on a high surface area solid support medium.

Without wishing to be bound by any theory, the applicants believe that using the solid support medium prevents the sequestrant from reacting with the seed crystal material, except when a support medium particle collides with a seed crystal. The overall amount of materials reacting would then be much less than if the sequestrant was in solution in the wash liquor.

As well as inhibiting poisoning of the seed crystal material, in some cases the immobilisation of the sequestrant may also reduce its toxicity.

Suitable solid support media include inorganic substrates such as silicas, clays and aluminosilicates. Organic substrates may also be used, such as linear and/or cross-linked polymers and copolymers, for example formed from vinyl monomers. Specific examples include polystyrene, polymethyl methacrylate and polymethacrylic acid. Especially preferred are macroporous or macroreticular organic materials, implying a high surface area per unit weight.

These and other suitable solid support materials include glasses or any of the materials described in Chapter 1 of N. K. Mathur et al, "Polymers as Aids in Organic Chemistry", Academic Press, London, 1980, ISBN 0-12-479850-0, P. Hodge & D. C. Sherrington, "Polymer Supported Reactions in Organic Synthesis", John Wiley & Sons, Chichester, 1990, ISBN 0-471-277-126 and the references cited therein.

The solid support material can have any particle size and any particle size distribution. However, in practice, average particle sizes of from 10 μm to 500 μm will often be used Average surface areas in the range of from 5 to 600 $m^2 g^{-1}$, average pore volumes of 0.3 to 4 ml $g^{-1}$ and mean pore diameters of from 2 to 200 nm are typical. In the context of the present disclosure any reference to average particle size means the D(3,2) average particle diameter unless explicitly stated to the contrary.

Methods of attachment of the sequestrant to the solid support material may be any of those well known for bonding of organic liquids to substrates, for example any of those described in Mathur et al referred to above, e.g. covalent, ionic and chemical bondings.

One particular preferred combination of sequestrant immobilised on a solid support material is a commercially available material. It consists of, diethylenetriaminepenta (methylene phosphoric acid) on an aluminosilicate support and is sold as 'Dequest 4066' ex Degussa.

However, a wide range of possible sequestrants is available for immobilisation on any solid support medium such as herein described.

In the context of the present invention, the term "heavy metal sequestrant" preferably, although not exclusively, means a material that for the equilibrium metal ion + sequestrant → sequestered metal ion has an equilibrium constant pK of 18 or greater at 25° C. and 0.1 mol/P ionic strength.

Typical functional moieties of heavy metal sequestrants include phosphonates, as well as alkyl and aryl amines and amides, alkyl and aryl phosphites, carboxylates and similar, or any of those mentioned in Chapter 14 of N. K. Mathur et al supra.

To enhance effectiveness, such functional moietes are often combined in the same molecule with different functional moieties, as is the case with the sequestrant ethylene diamine tetra-acetic acid (EDTA).

It is also possible to provide the sequestrant molecule with a 'spacer' group to separate the functional moiety-(ies) from the surface of the solid support medium which might otherwise inhibit the sequestering action during use. Suitable spacer groups include alkyl, alkoxylate and polyalkoxylate groups.

Preferably, the weight ratio of sequestrant to solid support medium is from 0.1 to 10 mmol $g^{-1}$, more preferably from 1 to 2 mmol $g^{-1}$.

The compositions of the present invention may be provided in any form, for example as powders, aqueous liquids, non-aqueous liquids as well as gels or pastes. The latter may also be aqueous or non aqueous.

For powder compositions, the amount of solid support medium together with the sequestrant may be from 0.01% to 5%, preferably from 0.1% to 3% and most preferably from 0.5% to 2% by weight of the total composition. For aqueous liquid compositions, this amount may be from 0.01% to 5%, preferably from 0.5% to 3% and most preferably from 1% to 2%. In the case of non-aqueous liquid compositions, the amount may be from 0.01% to 6%, preferably from 0.5% to 4% and most preferably from 1% to 3%.

Alkali metal carbonate builder is preferably sodium carbonate, although potasium carbonate may also be used. The seed crystal material is preferably calcite, although it may also be Aragonite.

Preferably, the weight ratio of alkali metal carbonate to seed crystal material is from 10:1 to 0.5:1, more preferably from 2:1to 3:1.

In powder compositions, the amount of alkali metal carbonate may for example be from 60% to 5%, preferably from 50% to 10%, more preferably from 30% to 20% by weight of the total composition.

In aqueous liquid compositions, the amount of the alkali metal carbonate may for example be from 55% to 5%, preferably from 30% to 5% and most preferably from 20% to 5% by weight of the total composition.

In non-aqueous liquid compositions the amount of the alkali meal carbonate may for example be from 55% to 5%, preferably from 35% to 5% and most preferably from 20% to 10% by weight of the total composition.

BLEACH SYSTEM

The compositions of the present invention may include a bleach. Suitable bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with a bleach precursor, or as a peroxy acid compound. In a more preferred embodiment, the composition will also comprise a bleach catalyst.

In the case of the inorganic persalt bleaches, the activator makes the bleaching more effective at lower temperatures, i.e. in the range from ambient temperature to about 60° C., so that such bleach systems are commonly known as low-temperature bleach systems and are well-known in the art. The inorganic persalt such as sodium perborate, both the monohydrate and the tetrahydrate, acts to release active oxygen in solution, and the activator is usually an organic compound having one or more reactive acyl residues, which cause the formation of peracids, the latter providing for a more effective bleaching action at lower temperatures than the peroxybleach compound alone.

The ratio by weight of the peroxybleach compound to the activator is from about 20:1to about 2:1, preferably from about 10:1 to about 3.5:1. Whilst the amount of the bleach system, i.e. peroxybleach compound and activator, may be varied between about 5% and about 50% by weight of the total liquid, it is preferred to use from about 6% to about 30% of the ingredients forming the bleach system. Thus, the preferred level of the peroxybleach compound in the composition is between about 5.5% and about 27% by weight, while the preferred level of the activator is between about 0.5% and about 14%, most preferably between about 1% and about 7% by weight.

Typical examples of the suitable peroxybleach compounds are alkalimetal perborates, both tetrahydrates and monohydrates, alkali metal percarbonates, persilicates and perphosphates, of which sodium perborate is preferred.

A particularly suitable bleach catalyst usable herein in combination with an oxygen bleach in the form of an inorganic persalt with or without a bleach precursor or as a peroxyacid compound, is a dinuclear manganese (III)—or Manganese (IV) complex as described in Applicant's European Patent Application Nos. 91201171.5 and 91201172.3.

Preferred catalysts of this class are those referred to as having the following formulae:

1) $[Mn^{IV}_2(m\text{-}O)_3(Me\text{-}TACN)_2](PF_6)_2$
2) $[Mn^{IV}_2(m\text{-}O)_3(Me/Me\text{-}TACN)_2](PF_6)_2$
3) $[Mn^{III}_2(m\text{-}O)(m\text{-}OAc)_2(Me\text{-}TACN)_2](PF_6)_2$
4) $[Mn^{III}_2(m\text{-}O)(m\text{-}OAc)_2(Me/Me\text{-}TACN)_2](PF_6)_2$ Wherein Me-TACN is 1,4,7-trimethyl-1,4,7-triazacyclononane, and Me/Me-TACN is 1,2,4,7-tetramethyl-1,4,7-triazacyclononane.

These catalysts may be used in the present invention in an amount corresponding to a Manganese level of from about 0.0001 to about 1.0% by weight, preferably from about 0.0005 to about 0.5% by weight.

The compositions of the present invention also include a sequestrant stabiliser for the bleach or bleach system, the stabiliser being immobilised on the solid support medium. Examples of such sequestrants are ethylene diamine tetramethylene phosphonate and diethylene triamine pentamethylene phosphonate or other appropriate organic phosphonate or salt thereof, such as the Dequest range hereinbefore described. These stabilisers can be used in acid or salt form, such as the calcium, magnesium, zinc or aluminium salt form. The stabiliser may be present at a level of up to about 1% by weight, preferably between about 0.1% and about 0.5% by weight.

The applicants have also found that liquid bleach precursors, such as glycerol triacetate and ethylidene heptanoate acetate, isopropenyl acetate and the like, also function suitably as a material for the liquid phase, thus obviating or reducing any need of additional relatively volatile solvents, such as the lower alkanols, paraffins, glycols and glycolethers and the like e.g. for viscosity control.

In general, the way to adapt the compositions of the present invention to powder, aqueous liquid, non-aqueous liquid etc form will be apparent to those skilled in the art in the light of this teaching.

By way of example, the present invention will be illustrated by a non-aqueous liquid cleaning composition.

In the case of a non-aqueous liquid composition, all ingredients before incorporation will either be liquid, in which case, in the composition they will constitute all or part of the liquid phase, or they will be solids, in which case, in the composition they will either be dispersed in the liquid phase or they will be dissolved therein. Thus as used herein, the term "solids" is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

In the context of this specification, all references to liquids refer to materials which are liquid at 25° C. at atmospheric pressure. They may be formulated in a very wide range of specific forms, according to the intended use. They may be formulated as cleaners for hard surfaces (with or without abrasive) or as agents for warewashing (cleaning of dishes, cutlery etc) either by hand or mechanical means, as well as in the form of specialised cleaning products, such as for surgical apparatus or artificial dentures. They may also be formulated as agents for washing and/or conditioning of fabrics.

Thus, the compositions will contain at least one agent which promotes the cleaning and/or conditioning of the article(s) in question, selected according to the intended application. Usually, this agent will be selected from surfactants, enzymes, bleaches, microbiocides, (for fabrics) fabric softening agents and (in the case of hard surface cleaning) abrasives. Of course in many cases, more than one of these agents will be present, as well as other ingredients commonly used in the relevant product form.

Preferably the viscosity of non-aqueous liquid compositions in accordance to the invention is less than 2,500 mPa.s at 21 $s^{-1}$, more preferably between 50 and 2,000, most preferably from 300 to 1,500.

SURFACTANT

Compositions according to the present invention may also contain one of more surfactants. Where those compositions are non-aqueous liquid and the surfactants are solids, the latter will usually be dissolved or dispersed in the liquid phase. Where the surfactants are liquids, they will usually constitute all or part of the liquid phase of the composition. However, in some cases the surfactants may undergo a phase change in the composition.

In general, whether for powder, aqueous liquid, non-aqueous liquid, gel or paste compositions, surfactants for use in the compositions of the invention may be chosen from any of the classes, sub-classes and specific materials described in "Surface Active Agents" Vol. I, by Schwartz & Perry, Interscience 1949 and "Surface Active Agents" Vol. II by Schwartz, Perry & Berch (Interscience 1958), in the current edition of "McCutcheon's Emulsifiers & Detergents" published by the McCutcheon division of Manufacturing Confectioners Company or in "Tensid-Taschenbuch", H. Stache, 2nd Edn., Carl Hanser Verlag, München & Wien, 1981.

In respect of all surfactant materials, but also with reference to all ingredients described herein as examples of components in compositions according to the present invention, unless the context requires otherwise, the term "alkyl" refers to a straight or branched alkyl moiety having from 1 to 30 carbon atoms, whereas lower alkyl refers to a straight or branched alkyl moiety of from 1 to 4 carbon atoms. These definitions apply to alkyl species however incorporated (e.g. as part of an aralkyl species). Alkenyl (olefin) and alkynyl (acetylene) species are to be interpreted likewise (i.e. in terms of configuration and number of carbon atoms) as are equivalent alkylene, alkenylene and alkynylene linkages. For the avoidance of doubt, any reference to lower alkyl or $C_{1-4}$ alkyl (unless the context so forbids) is to be taken specifically as a recitation of each species wherein the alkyl group is (independent of any other alkyl group which may be present in the same molecule) methyl, ethyl, iso-propyl, n-propyl, n-butyl, iso-butyl and t-butyl, and lower (or $C_{1-4}$) alkylene is to be construed likewise.

Preferably the total level of surfactants is from 5–75% by weight of the composition, more preferably 15–60%, most preferably 25–50%.

NON-IONIC SURFACTANTS

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes.

Also common are fatty acid mono- and dialkanolamides in which the alkyl group of the fatty acid radical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule.

In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants' published European specification EP-A-225,654, especially for use as all or part of the liquid phase of a non-aqueous liquid composition.

Also preferred are those ethoxylated nonionics which are the condensation products of fatty alcohols with from 9 to 15 carbon atoms condensed with from 3 to 11 moles of ethylene oxide. Examples of these are the condensation products of C11-13 alcohols with (say) 3 to 7 moles of ethylene oxide. These may be used as the sole nonionic surfactants or in combination with those of the described in the last-mentioned European specification, especially as all or part of the liquid phase of a non-aqueous liquid composition.

Another class of suitable nonionics comprise the alkyl polysaccharides (polyglycosides/oligosaccharides) such as described in any of specifications U.S. Pat. No. 3,640,998; U.S. Pat. No. 3,346,558; U.S. Pat. No. 4,223,129; EP-A-92,355; Ep-A-99,183; Ep 70,074, '75, '76, '77; EP 75,994, '95, '96.

Mixtures of different nonionic detergent surfactants may also be used. Mixtures of nonionic detergent surfactants with other detergent surfactants such as anionic, cationic or ampholytic detergent surfactants and soaps may also be used. Preferably the level of nonionic surfactants is from 5–75% by weight of the composition, more preferably 15–60%, most preferably 25–50%.

ANIONIC SURFACTANTS

Examples of suitable anionic detergent surfactants are alkali metal, ammonium or alkylolamine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, and olefin sulphonates prepared by sulphonation of C10–24 alpha-olefins and subsequent neutralization and hydrolysis of the sulphonation reaction product.

NON-AQUEOUS ORGANIC SOLVENT

If a composition according to the present invention is a substantially non-aqueous liquid composition comprising particulate solids dispersed in a non-aqueous liquid phase, then the most suitable liquids to choose to form the liquid phase are those organic materials having polar molecules. In particular, those comprising a relatively lipophilic part and a relatively hydrophilic part, especially a hydrophilic part rich in electron lone pairs, tend to be well suited. This is completely in accordance with the observation that liquid surfactants, especially polyalkoxylated nonionics, are one preferred class of material for the liquid phase.

Non-surfactants which are suitable for use as the liquid phase include those having the preferred molecular forms referred to above although other kinds may be used, especially if combined with those of the former, more preferred types. In general, the non-surfactant solvents can be used alone or with in combination with liquid surfactants. Non-surfactant solvents which have molecular structures which fall into the former, more preferred category include ethers, polyethers, alkylamines and fatty amines, (especially di- and tri-alkyl- and/or fatty-N-substituted amines), alkyl (or fatty) amides and mono- and di-N-alkyl substituted derivatives thereof, alkyl (or fatty) carboxylic acid lower alkyl esters, ketones, aldehydes, and glycerides. Specific examples include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Many light solvents with little or no hydrophilic character are in most systems, unsuitable on their own Examples of these are lower alcohols, such as ethanol, or higher alcohols, such as dodecanol, as well as alkanes and olefins. However, they can be combined with other liquid materials.

PROPORTION OF LIQUID PHASE

The liquid phase of a non-aqueous liquid composition (whether or not comprising liquid surfactant) in an amount of at least 10% by weight of the total composition. The amount of the liquid phase present in the composition may be as high as about 90%, but in most cases the practical amount will lie between 20 and 70% and preferably between 35 and 50% by weight of the composition.

SOLIDS CONTENT

In general, the solids content of a non-aqueous liquid composition may be within a very wide range, for example from 10–90%, usually from 30–80% and preferably from 50–65% by weight of the final composition. The solid phase should be in particulate form and have an average particle size of less than 300 μm, preferably less than 200 μm, more preferably less than 100 μm, especially less than 10 μm. The particle size may even be of sub-micron size. The proper particle size can be obtained by using materials of the appropriate size or by milling the total product in a suitable milling apparatus. In order to control aggregation of the solid phase leading to unredispersible settling or setting of the composition, it is preferred to include a deflocculant therein.

OTHER INGREDIENTS

Regardless of the kind of composition, i.e. whether solid, liquid etc, in addition to the components already discussed, there are very many other ingredients which can be incorporated in liquid cleaning products.

There is a very great range of such other ingredients and these will be chosen according to the intended use of the product. However, the greatest diversity is found in products for fabrics washing and/or conditioning. Many ingredients intended for that purpose will also find application in products for other applications (e.g. in hard surface cleaners and warewashing liquids).

DETERGENCY BUILDERS

As well as the alkali-metal carbonate builder, compositions of the present invention may comprise one or more other detergency builders. As explained above, some of these may be present as the solid support material.

In general, the auxilliances inorganic builders comprise the various phosphate-, silicate-, borate- and aluminosilicates-type materials, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal bicarbonates, borates, silicates, metasilicates, and crystalline and amorphous aluminosilicates.

Examples of organic builders include the alkali metal, ammonium and substituted ammonium, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/ polymaleic acid co-polymers and their salts, such as those sold by BASF under the Sokalan Trade Mark. Preferably the level of builder materials is from 1 to 40% by weight of the composition, more preferably 5–40% by weight.

STABILISERS

In the case of non-aqueous liquid dispersions, to keep the solids in dispersion, it is usually preferred to incorporate one or more agents to stabilise the rheology of the compositions. Such stabilisers include materials to inhibit settling of the solid particles and so minimise clear layer formation. Examples of such materials are highly voluminous metal and metaloid oxides such as described in UK Patent Specification GB 1 205 711. Another suitable class stabilisers of this type comprises the hydrophobically modified silicas.

Another type of stabiliser is a deflocculant. Deflocculants inhibit the aggregation of particulate solids which could both accelerate sedimentation and ultimately lead to setting (gelling or solidification).

Therefore non-aqueous liquid compositions of the present invention preferably also comprise a deflocculant material. In principle, any material may be used as a deflocculant provided it fulfils the deflocculation test described in European Patent Specification EP-A-266199 (Unilever). The capability of a substance to act as a deflocculant will partly depend on the solids/liquid phase combination. However, especially preferred are acids.

"Fatty" anions are very suitable deflocculants, and a particularly preferred class of deflocculants comprises anionic surfactants. Although anionics which are salts of alkali or other metals may be used, particularly preferred are the free acid forms of these surfactants (wherein the metal cation is replaced by an H+cation, i.e. proton). These anionic surfactants include all those classes, subclasses and specific forms described in the aforementioned general references on surfactants, viz, Schwartz & Perry, Schwartz Perry and Berch, McCutcheon's, Tensid-Taschenbuch; and the free acid forms thereof. Many anionic surfactants have already been described hereinbefore. In the role of deflocculants, the free acid forms of these are generally preferred.

In particular, some preferred sub-classes and examples are the C10–C22 fatty acids and dimers thereof, the C8–C18 alkylbenzene sulphonic acids, the C10–C18 alkyl- or alkylether sulphuric acid monoesters, the C12–C18 paraffin sulphonic acids, the fatty acid sulphonic acids, the benzene-, toluene-, xylene- and cumene sulphonic acids and so on. Particularly are the linear C12–C18 alkylbenzene sulphonic acids.

As well as anionic surfactants, zwitterionic-types can also be used as deflocculants. These may be any described in the aforementioned general surfactant references. One example is lecithin.

The level of the deflocculant material in the composition can be optimised by the means described in the aforementioned EP-A-266199, but in very many cases is at least 0.01%, usually 0.1% and preferably at least 1% by weight, and may be as high as 15% by weight. For most practical purposes, the amount ranges from 2–12%, preferably from 4–10% by weight, based on the final composition.

MISCELLANEOUS OTHER INGREDIENTS

Whatever the form (solid, liquid etc) of compositions according to the present invention, optionally they may contain other ingredients which comprise those remaining ingredients which may be used in liquid cleaning products, such as fabric conditioning agents, enzymes, perfumes (including deoperfumes), micro-biocides, colouring agents, fluoresces, soil-suspending agents (anti-redeposition agents), corrosion inhibitors, enzyme stabilising agents, bleach catalysts and lather depressants.

Amongst the fabric conditioning agents which may be used, either in fabric washing liquids or in rinse conditioners, are fabric softening materials, quaternary ammonium salts, imidazolinium salts, fatty amines and cellulases.

Enzymes which can be used in liquids according to the present invention include proteolytic enzymes, amylolytic enzymes and lipolytic enzymes (lipases). Various types of proteolytic enzymes and amylolytic enzymes are known in the art and are commercially available. They may be incorporated, e.g., as "prills" "marumes" or suspensions.

The fluorescent agents which can be used in the liquid cleaning products according to the invention are well known and many such fluorescent agents are available commercially. Usually, these fluorescent agents are supplied and used in the form of their alkali metal salts, for example, the sodium salts. The total amount of the fluorescent agent or agents used in a detergent composition is generally from 0.02–2% by weight.

When it is desired to include anti-redeposition agents in the liquid cleaning products, the amount thereof is normally from about 0.1% to about 5% by weight, preferably from about 0.2% to about 2.5% by weight of the total liquid composition. Preferred anti-redeposition agents include carboxy derivatives of sugars and celluloses, e.g. sodium carboxymethyl cellulose, anionic poly-electrolytes, especially polymeric aliphatic carboxylates, or organic phosphonates.

When it is desired to include a bleach catalyst, a manganese complex as described in Applicants' co-pending European Patent Application No. 91201171.5 and No. 91201172.3 can be used in an amount corresponding to a manganese level of from 0.0001 to about 1.0% by weight, preferably from 0.0005 to 0.5% by weight.

WATER

When compositions according to the present invention are powders, they may contain some water of crystallisation. If they are aqueous liquids, they may contain, for example from 10 to 85% by weight of the total composition of water.

If the compositions are substantially non-aqueous liquids, i.e. containing little or no free water, then preferably the water content is no more than 5%, preferably less than 3%, especially less than 1% by weight of the total composition. It has been found that the higher the water content, the more likely it is for the viscosity of non-aqueous liquids to be too high, or even for setting to occur.

PROCESSING

Suitable methods for manufacturing powder and aqueous liquid cleaning compositions are well known to those skilled in the art.

During manufacture of non-aqueous liquid compositions, it is preferred that all raw materials should be dry and (in the case of hydratable salts) in a low hydration state, e.g. anhydrous phosphate builder, sodium perborate monohydrate and dry calcite abrasive, where these are employed in the composition. In a preferred process, the dry, substantially anhydrous solids are blended with the liquid phase in a dry vessel. If deflocculant materials are used, these should preferably -at least partly- be mixed with the liquid phase, prior to the addition of the solids. In order to minimise the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 μm, preferably 0.5 to 50 μm, ideally 1 to 10 μm. A preferred combination of such mills is a colloid mill operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of deaeration. Suitable equipment for cooling (e.g. heat exchangers) and de-aeration will be known to those skilled in the art.

For ensuring that any clay material present consists of platelet shaped particles of the desired particle size it is preferred to mix the clay materials into the compositions under high shear conditions.

It follows that all equipment used in this process should preferably be completely dry, special care being taken after any cleaning operations. The same is true for subsequent storage and packing equipment.

EXAMPLE 1

Non-aqueous Liquid Formulation

| Component | % Wt |
|---|---|
| Vista 1012-62 (1) | 23.8 |
| Synperonic A3 (2) | 19.5 |
| Glycerol Triacetate | 5.0 |
| Marlon AS 3 (3) | 6.0 |
| Anti-foam | 1.0 |
| Sodium carbonate | 18.0 |
| Socal U 3 (4) | 7.0 |
| SCMC | 1.0 |
| Versa TL 3 (5) | 1.0 |
| Fluorescer | 0.1 |
| Sipernat D 17 (6) | 3.0 |
| Sequestrant 4066 (7) | 0 or 2.0 |
| Sodium perborate (monohy.) | 10.5 |
| TAED | 3.0 |
| Savinase 16 SL | 0.4 |
| Lipolase 100 SL | 0.3 |
| Perfume | 0.4 |
| Colour | 0.0025 |

(1) Narrow range ethoxylated nonionic ex Vista
(2) C13-15 alcohol alkoxylated with on average 3 EO groups ex ICI
(3) Anionic detergent in acid form ex Huls
(4) High surface area calcium carbonate
(5) Copolymer of sulphonated styrene and maleic anhydride, Na salt, ex National Starch & Chemical Co.
(6) Hydrophobically modified silica dispersant ex Degussa
(7) None, or 2% as wt % of sequestrant alone (corresponds to 6.2% by weight of Dequest 4066, an aluminosilicate with bound phosphonate sequestrant, ex Degussa). Refer to legend of Table I below.

EXAMPLES 2 & 3

Powder Formulations

| | Ex. 2 % wt | Ex. 3 % wt |
|---|---|---|
| Alkyl benezene sulphonate Na Salt | 18 | 13 |
| Sodium silicate | 10 | 13 |
| Sodium carbonate | 53 | 20 |
| Calcite (Socal U3 ex Solvay) | 5 | 25 |
| Tinopal CBS-X (fluorescer) | 0.06 | 0.07 |
| Sodium sulphate | 7.1 | 13 |
| Perfume | 0.2 | 0.12 |
| Sequestrant (see Table I) | 0 or 2 | 0 or 2 |
| Water and minors | 6.64 | 15.81 |

EXAMPLE 4

Aqueous Liquid Formulation

| | % WT |
|---|---|
| Sodium ethoxy dodecyl sulphate | 2 |
| Dodecyl alcohol 8 ethoxylate | 1 |
| Alkyl benzene sulphonate Na salt | 8 |
| Sodium carbonate | 11 |
| Calcite (Calofort U ex Sturge) | 6 |
| Tinopal CBS-X | 0.14 |
| Dye | 0.004 |
| Perfume | 0.2 |
| Sequestrant (see Table I) | 0 or 2 |
| Water and minors | 71.656 |

To assess the performance of compositions of the present invention, the compositions of Examples 1–4 were tested in the washing of the various test cloths. Tergotometer reflectivity and free calcium ion levels are quoted in all cases. For all of Examples 1–4, four samples were tested. Sample 1 is a control with no sequestrant whilst sample 2 contains only non-immobilised sequestrant.

TABLE I

| | Results after a 15 minute wash at 40° C., 25° French hard, 0.5 ppm $Fe^{3+}$. | | | | | | | | | | | | | | | |
|---|---|---|---|---|---|---|---|---|---|---|---|---|---|---|---|---|
| | Example 1 Sample No. | | | | Example 2 Sample No. | | | | Example 3 Sample No. | | | | Example 4 Sample No. | | | |
| | 1 | 2 | 3 | 4 | 1 | 2 | 3 | 4 | 1 | 2 | 3 | 4 | 1 | 2 | 3 | 4 |
| Delta R460nm grass stain | 7.4 | 9.3 | 11.2 | 9.1 | 6.8 | 8.3 | 7.9 | 8.4 | 5.2 | 7.7 | 8.1 | 6.4 | 4.3 | 5.1 | 4.9 | 4.6 |
| Delta R460nm Blackberry stain | 29.5 | 32.7 | 32.4 | 30.3 | 27.1 | 30.1 | 31.4 | 28.3 | 26.2 | 27.3 | 26.1 | 27.0 | 20.3 | 24.5 | 25.0 | 20.0 |
| AS-9 test cloth | 17.0 | 14.1 | 17.1 | 16.8 | 18.5 | 14.0 | 17.9 | 18.1 | 16.1 | 12.9 | 17.9 | 15.2 | 15.8 | 12.8 | 14.3 | 14.3 |
| Tea stain BC-1 test cloth | 6.1 | 7.3 | 7.2 | 6.8 | — | — | — | — | — | — | — | — | — | — | — | — |
| pCa | 5.0 | 3.9 | 4.7 | 4.8 | 5.4 | 4.0 | 4.9 | 4.9 | 4.8 | 3.9 | 4.7 | 4.7 | 5.1 | 3.7 | 4.8 | 4.7 |

BC-1 is a bleach sensitive test cloth
AS-9 is a builder sensitive test cloth
pCa is the free calcium level determined using a calcium i sensitive electrode Radiometer type 3003a.
$pCa^{2+} = -\log [Ca^{2+}]$ = the negative logarithm to base ten of the free calcium ion concentration.
1 = As example but with no sequestrants
2 = With 2% Dequest 2066 extra
3 = With 2% Dequest 4066 extra
4 = With 2% Triphenylphosphine (2 m · mol/g) on macroporous polystrene Amberlite XAD-2.

I claim:

1. A cleaning composition comprising:

(a) 5 to 60% alkali metal carbonate builder;

(b) a seed crystal material for said carbonate builder wherein the ratio of carbonate builder to seed crystal material is from 10:1 to 0.5:1;

(c) a heavy metal sequestrant immobilized on a high surface area solid support medium wherein the amount of heavy metal sequestrant plus solid support medium is from 0.01% to 5% of the total cleaning composition and wherein the weight ratio of heavy sequestrant to solid support medium is from 0.1 to 10 mmol/gram and wherein poisoning of the seed crystal material by the heavy metal sequestrant is avoided.

2. A cleaning composition according to claim 1, containing a bleaching effective amount of a bleach.

3. A cleaning composition according to claim 1, wherein the D(3,2) average particle size of the solid support medium is from 10 μm to 500 μm.

4. A cleaning composition according to claim 1, wherein the weight ratio of sequestrant to solid support medium is from 1–2 mmol/gram.

5. A cleaning composition according to claim 1, wherein the sequestrant plus solid support medium is from 0.1 to 3% by weight.

6. A cleaning composition according to claim 1, wherein the solid support medium comprises silica, a clay, an aluminosilicate, polystyrene, polymethyl methacrylate or polymethacrylic acid.

7. A cleaning composition according to claim 1, wherein the weight ratio of alkali metal carbonate to seed crystal material is from 2:1 to 3:1.

8. A cleaning composition according to claim 1, wherein the metal carbonate builder is sodium carbonate.

9. A cleaning composition according to claim 1, wherein the seed crystal material is calcite.

* * * * *